US010215441B2

(12) United States Patent
Cai

(10) Patent No.: US 10,215,441 B2
(45) Date of Patent: Feb. 26, 2019

(54) INTEGRATED LIGHT AND HEAT ARRANGEMENT OF LOW PROFILE LIGHT-EMITTING DIODE FIXTURE

(71) Applicant: Hongyi Cai, Lawrence, KS (US)

(72) Inventor: Hongyi Cai, Lawrence, KS (US)

( * ) Notice: Subject to any disclaimer, the term of this patent is extended or adjusted under 35 U.S.C. 154(b) by 0 days.

(21) Appl. No.: 15/486,797

(22) Filed: Apr. 13, 2017

(65) Prior Publication Data

US 2017/0299167 A1 Oct. 19, 2017

Related U.S. Application Data

(60) Provisional application No. 62/323,066, filed on Apr. 15, 2016.

(51) Int. Cl.

| | |
|---|---|
| ***F21S 6/00*** | (2006.01) |
| ***F21S 8/06*** | (2006.01) |
| ***F21V 5/04*** | (2006.01) |
| ***F24D 1/00*** | (2006.01) |
| ***F21V 29/70*** | (2015.01) |
| ***F21V 29/83*** | (2015.01) |
| ***F21V 29/90*** | (2015.01) |
| ***F24F 3/153*** | (2006.01) |
| ***F21W 131/10*** | (2006.01) |
| ***F21Y 105/10*** | (2016.01) |

(Continued)

(52) U.S. Cl.

CPC ..... *F24F 13/078* (2013.01); *F21V 29/70* (2015.01); *F24D 1/00* (2013.01); *F21S 6/002* (2013.01); *F21S 6/005* (2013.01); *F21S 8/06* (2013.01); *F21V 5/04* (2013.01); *F21V 29/83* (2015.01); *F21V 29/90* (2015.01); *F21W 2131/10* (2013.01); *F21Y 2105/10* (2016.08); *F21Y 2105/16* (2016.08); *F21Y 2115/10* (2016.08); *F24F 3/153* (2013.01); *F24F 2221/02* (2013.01)

(58) Field of Classification Search

CPC ..... F24F 2221/02; F24F 3/056; F24F 13/078; F21V 29/60; F21V 29/70; F21V 29/90

See application file for complete search history.

(56) References Cited

U.S. PATENT DOCUMENTS 7,278,761 B2 * 10/2007 Kuan ..... F21S 8/086 362/294

8,651,704 B1 2/2014 Gordin et al.

(Continued)

*Primary Examiner* — Alexander K Garlen

(74) *Attorney, Agent, or Firm* — Erise IP, P.A.

(57) ABSTRACT

According to aspects of the embodiments, an integrated light and heat arrangement of low profile light-emitting diode (LED) fixture to harness both the light and the heat generated by the LEDs is described. New system architectures and example form factors are provided for the development of new LED fixtures for integrative lighting and heating arrangement to increase their overall luminaire system efficiency. The integrative lighting and heating arrangement of the LED fixture in low profile design can minimize interference of harvesting the heat from LEDs with their light output. The heat which would otherwise be wasted from LEDs is harvested for the purpose of heating up some nearby body, such as a body of air, or a component, or a lens to accomplish some benefits, including, for example, reduction in overall energy uses for space heating, cooling, and lighting and associated cost, and melting snow and de-icing on outdoor LED fixtures for safety and security.

19 Claims, 14 Drawing Sheets

(51) Int. Cl.

| | |
|---|---|
| ***F21Y 105/16*** | (2016.01) |
| ***F21Y 115/10*** | (2016.01) |
| ***F24F 13/078*** | (2006.01) |

(56) References Cited

U.S. PATENT DOCUMENTS

| | | | | |
|---|---|---|---|---|
| 8,723,425 | B2 | 5/2014 | Pokrajac | |
| 2009/0034231 | A1* | 2/2009 | Chu | F21V 29/004 362/92 |
| 2009/0067182 | A1* | 3/2009 | Hsu | F21S 6/003 362/373 |
| 2011/0198977 | A1* | 8/2011 | VanderSluis | F21S 8/02 313/35 |
| 2011/0211332 | A1* | 9/2011 | Hilscher | F21V 7/22 362/84 |
| 2012/0235579 | A1* | 9/2012 | Chemel | F21S 2/005 315/152 |
| 2013/0344795 | A1* | 12/2013 | Schreiber | F24F 13/078 454/293 |
| 2014/0016318 | A1 | 1/2014 | Pokrajac | |
| 2014/0199168 | A1* | 7/2014 | Spiro | F04D 29/582 416/5 |
| 2015/0009702 | A1* | 1/2015 | Fiederling | F21S 45/60 362/547 |
| 2016/0209022 | A1 | 7/2016 | Cai et al. | |
| 2016/0381733 | A1* | 12/2016 | Lee | F24C 7/06 362/92 |
| 2017/0003012 | A1* | 1/2017 | Schreiber | F21V 29/503 |
| 2017/0205082 | A1* | 7/2017 | Kim | F24F 1/0007 |

* cited by examiner

INTEGRATED LIGHT AND HEAT ARRANGEMENT OF LOW PROFILE LIGHT-EMITTING DIODE FIXTURE

RELATED APPLICATION

This application claims the benefit of U.S. Provisional Application No. 62/323,066, filed Apr. 15, 2016, the entire contents of which application is hereby incorporated herein by reference.

BACKGROUND

Artificial light sources often produce heat. Most lamps convert only part of the input energy into visible light, with the remaining energy being wasted as heat. For example, a large portion of the electricity used by artificial light sources, such as traditional incandescent, fluorescent, and high intensity discharge (HID) lamps and new light-emitting diode (LED) lights, is converted to heat.

Light-emitting diodes (LEDs) may be predominant in buildings and transport infrastructure for illumination and signaling in the near future. LEDs have small size, long life, and relatively high luminous efficacy, enabling various new applications in illumination and signaling. LEDs are expected to displace many traditional artificial lamps and light sources used in existing buildings and transport infrastructure.

BRIEF DESCRIPTION OF THE DRAWINGS

For a more complete understanding of the embodiments and the advantages thereof, reference is now made to the following description, in conjunction with the accompanying figures briefly described as follows.

Figure 1A:
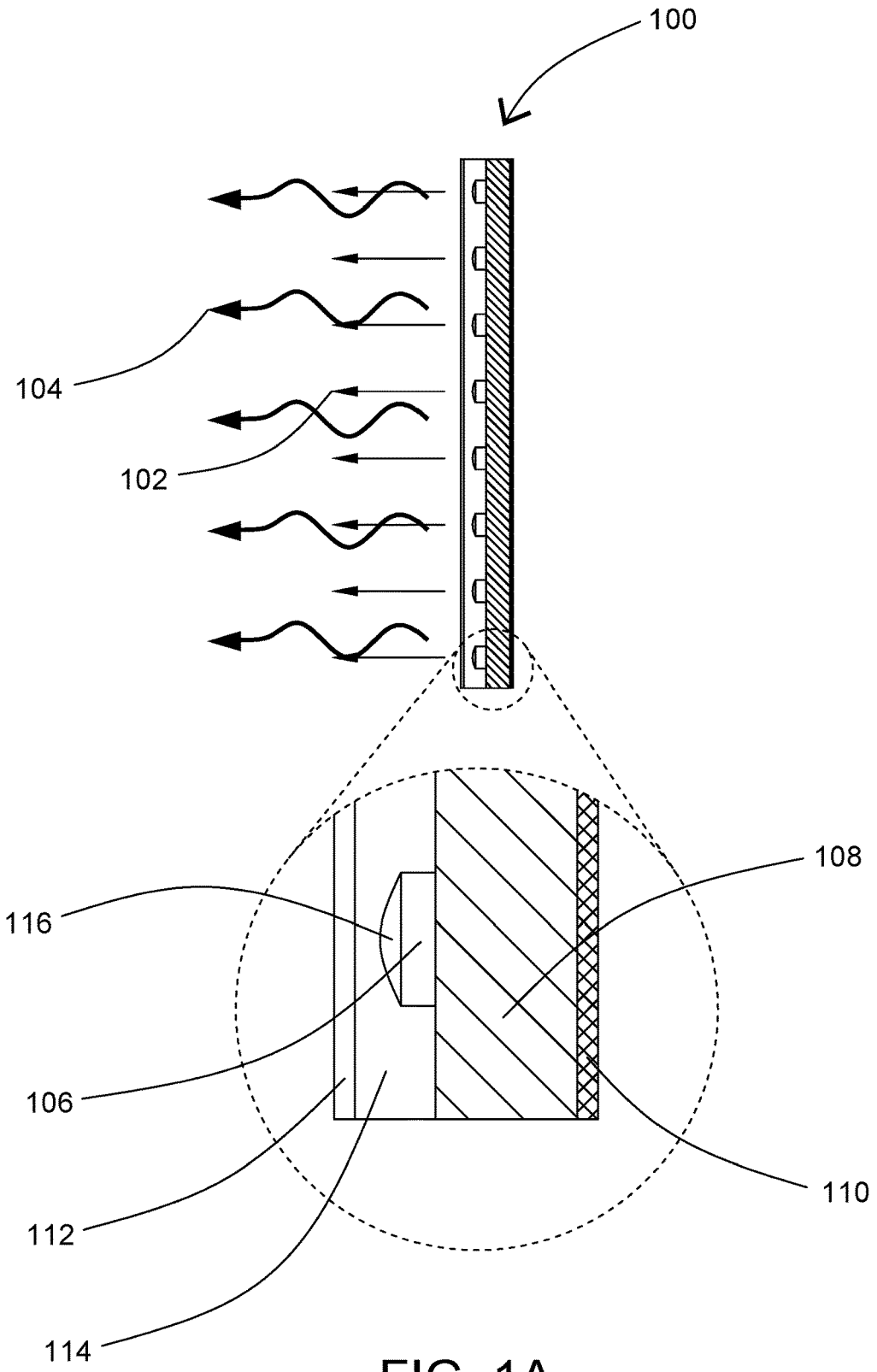
FIG. 1A illustrates an embodiment for the first type of fixture system architecture in which the light and heat generated by Light-emitting diodes (LEDs) or other appropriate artificial lamps and light sources are directed to the same direction in the front towards the fixture lens.

The drawings illustrate only example embodiments and are therefore not to be considered limiting of the scope of the embodiments described herein, as other embodiments are within the scope of this disclosure. The elements and features shown in the drawings are not necessarily drawn to scale, emphasis instead being placed upon clearly illustrating the principles of the embodiments. Additionally, certain dimensions or positionings may be exaggerated to help visually convey certain principles. In the drawings, similar reference numerals between figures designate like or corresponding, but not necessarily the same, elements.

DETAILED DESCRIPTION

In the following paragraphs, the embodiments are described in further detail by way of example with reference to the attached drawings. The embodiments are not to be considered limited in structure, form, function, or application to the examples set forth herein.

Embodiments disclosed herein involve using heat generated by light-emitting diode (LED) light fixtures for the purpose of heating up some nearby body, e.g., a body of air, or a component, e.g., a lens to accomplish some benefit. In most buildings, the heat generated by artificial light sources may impact indoor heating and cooling energy usage requirements. In other cases, the heat generated by artificial light sources may be used or relied upon for a particular purpose, for example, to melt snow on outdoor lighting fixtures and de-ice.

According to the embodiments described herein, an integrated light and heat arrangement of low profile LED fixture to harness both the light and the heat generated by the LEDs is described. The integrative lighting and heating arrangement of the LED fixture is designed in part to harvest the heat which would otherwise be wasted from LEDs for beneficial heating purposes, such as heating a conditioned interior space in building structures or vehicles for energy savings, and heating the lens of outdoor LED fixtures to melt snow and de-ice under wintery conditions. In addition, the integrative lighting and heating arrangement of the LED fixture in low profile design would have other benefits, such as minimized or eliminated interference of harvesting the heat from LEDs with their light output, improvement of the lighting performance of the LED fixture in low profile through integration with the building or transport systems, increased overall luminaire system efficiency, and reduced costs. The integrated light and heat arrangement of LED fixture is configured to increase the overall LED luminaire system efficiency.

LEDs may be predominant in buildings, urban spaces and transport infrastructure for illumination in the near future to displace many traditional artificial lamps and light sources. Although with relatively high luminous efficacy, LEDs still produce a good amount of heat. In some cases, most (approximately 70-80%) of the electricity used by LEDs is converted to heat rather than light. Nonetheless, the design of existing LED luminaires is targeted to optimize their luminous efficacy but often does not effectively harvest the LED heat for beneficial heating uses, for example, in the conditioned interior spaces of buildings and vehicles or to heat the lens of the light-emitting surfaces of outdoor LED fixtures. This leads to a problem of waste energy resulting in lowered overall LED luminaire system efficiency.

There are certain technical barriers to harvesting the heat of conventional or traditional lighting fixtures for energy savings. For example, traditional light sources (e.g., incandescent, fluorescent, metal halide, high pressure sodium, etc.) generate light and heat in a same-direction mixed energy flux, which hinders the ability to efficiently harvest lamp heat without interfering with the light output. For uniform light distribution requirements, the distance between a lamp and the lens of the fixture light-emitting surface is also relatively large resulting in a deep lamp mounting position in the fixture housing that would impact the amount of lamp heat transferred to the lens and the conditioned interior space. Additionally, due to their relatively large size, conventional light sources and fixtures are difficult to integrate with typical building heating, ventilation and air conditioning (HVAC) systems. Often a large portion of the lamp heat is trapped inside the luminaire housing and/or the ceiling cavity and lost.

Some of these technical barriers can be overcome with new LED technologies and the innovations described herein. LEDs have two unique characteristics that other artificial light sources do not have. First, LEDs are relatively small but bright point light sources and can fit in small spaces to enable efficient integration with HVAC systems in buildings and vehicles and outdoor transport system. It is possible to keep a relatively small gap (e.g., less than ¼-½") between multiple LEDs in an array and the lens of the fixture light-emitting surface for maximum heat transfer from LEDs to the lens. Second, the heat generated by LEDs is not radiated in the same direction as the light, but remains on the back of the diode itself. With innovative LED technologies, the heat generated by LED luminaires can be efficiently harvested, without interruption of their forward-emitting light output, for the use in conditioned spaces in building structures and vehicles for energy savings, and in outdoor luminaires and signal lights to heat the fixture lens to melt snow and de-ice under wintery conditions. Accordingly, the two unique characteristics of LEDs enable an integrative lighting and heating arrangement of new types of indoor and outdoor LED fixtures in low profile design with genuine LED system architectures and form factors.

In the context outlined above, the embodiments described herein are directed to an integrated light and heat arrangement of LED fixtures in low profile to harness both the light and the heat generated by the LEDs with increased overall luminaire system efficiency. The integrative lighting and heating arrangement can be used in part in the development of innovative LED luminaires to be integrated with existing building HVAC systems for harvesting both the light and the heat generated by LEDs for use in interior conditioned spaces to minimize overall energy uses in buildings or vehicles for spacing heating, cooling, and lighting. The integrative lighting and heating arrangement can also be adopted in the development of new outdoor LED fixtures for harvesting the LED heat to heat the lens of the fixture light-emitting surfaces to melt snow and de-ice under wintery conditions. In that context, new types of LED fixtures are configured with various system architectures and form factors to direct heat generated by LEDs, without interruption with their light output, to conditioned interior spaces in buildings and vehicles or to the lens of light-emitting surfaces of outdoor LED fixture.

Figure 1B:
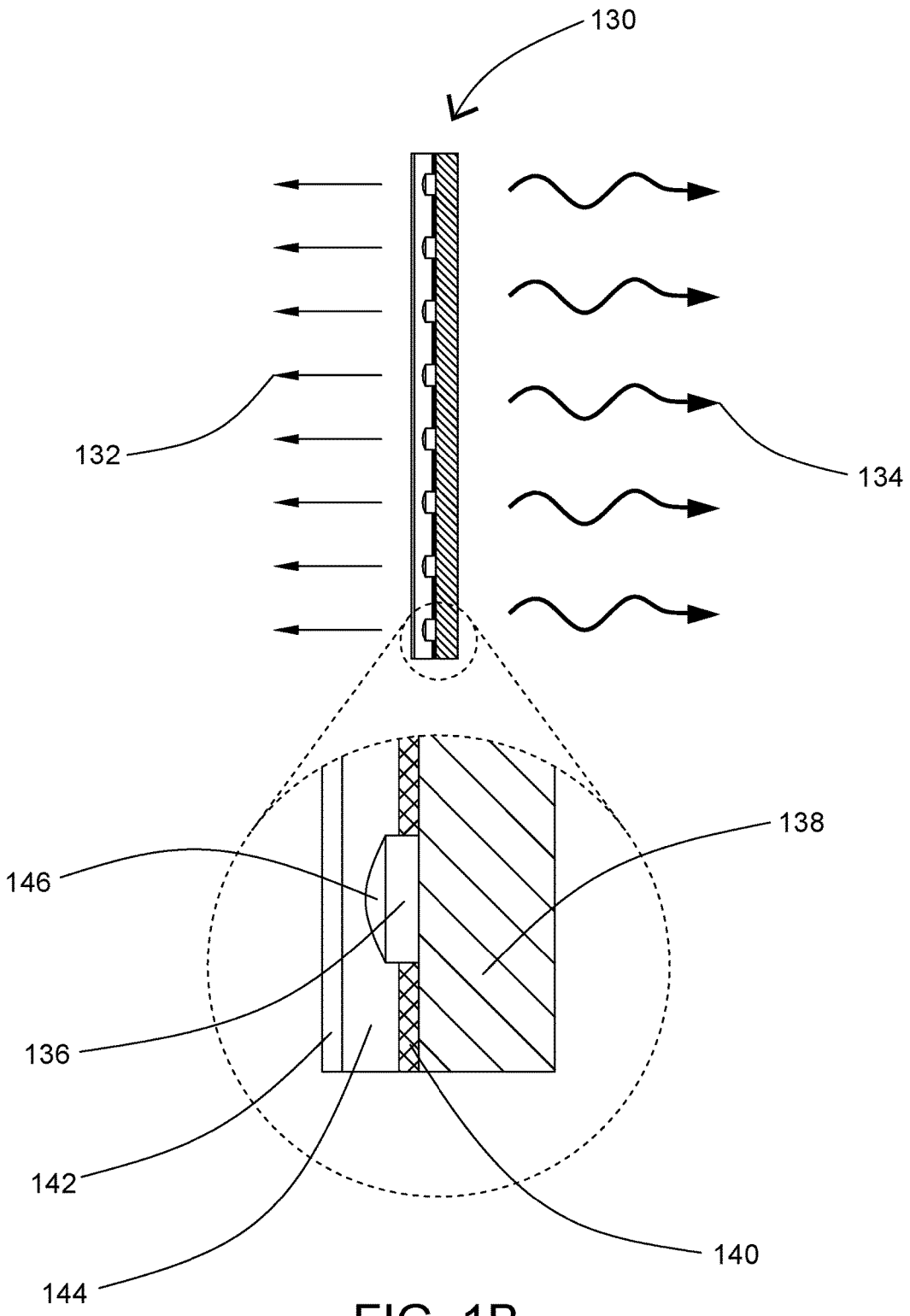
FIG. 1B illustrates an embodiment for the second type of fixture system architecture in which the light and heat generated by LEDs or other appropriate artificial lamps and light sources are directed to separate directions, the light towards the fixture lens in the front, the heat towards the back.
Figure 1C:
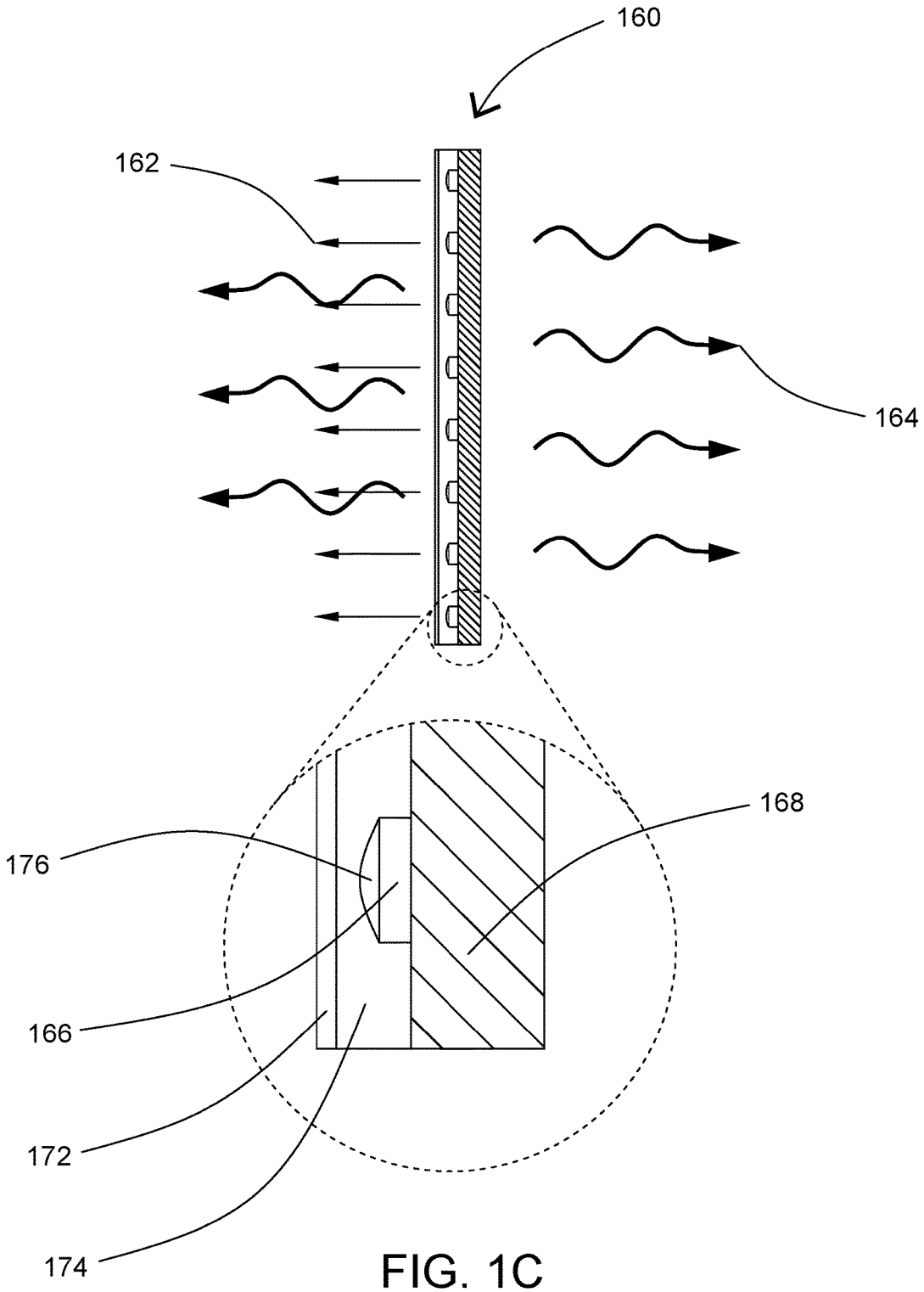
FIG. 1C illustrates an embodiment for the third type of fixture system architecture with omitted insulation, in which the light of LEDs or other appropriate artificial lamps and light sources is directed to the fixture lens in the front, and the heat is directed to both directions in the front and back.

In the context outlined above, innovative system architectures of new LED fixtures to harvest both the light and the heat generated by LEDs are described herein. FIGS. 1A-C illustrate three embodiments for system architectures where an LED array will be used for not only lighting, but also in the utilization of the heat transmitted from the array. The arrangements disclosed are low-profile arrangements. As shown in the example configuration of LED light fixture 100 illustrated in FIG. 1A, multiple LEDs 106 are mounted on a heat conduit, e.g., a passive heat exchanger 108 or other thermally conductive device. It should be recognized that the use of the terms "heat conduit" as used in this application are to be interpreted as meaning any relatively thermally-conductive thing, unless it is otherwise specified in the claims.

In the disclosed embodiments, member 108 is a heat exchanger having a low profile design that absorbs the heat generated by the LEDs and quickly disperses the heat emitted from the LEDs in desired direction(s). The LEDs 106 can be any suitable type(s) (for example, white light LEDs, color light LEDs, near infrared light LEDs, or UV light LEDs), with preference, in some embodiments, for smaller size and relatively higher efficiency, and can be evenly (or relatively evenly) mounted on the heat exchanger 108. While the light 102 of the LEDs 106 is emitted to the forward direction, the heat 104 generated by the LEDs 106 is absorbed and dispersed by the heat exchanger 108 to the desired direction(s). In the FIG. 1A embodiment, the light 102 and heat 104 are directed on the same direction relative to the array 100. This enables the heat 104 to be used in a variety of possible ways to improve habituated environments. E.g., in cooperation with an existing heating, ventilating, cooling (HVAC) system for a reduction in overall building energy uses for space heating, cooling, and lighting. Additionally, this sort of arrangement could be used for outdoor applications such as roadway luminaires, sports lighting, security video cameras with integrated LED lights; traffic lights, railroad signals, airport signals, ship/boat port signals; headlights and taillights of cars and snowmobiles, etc., for melting snow accumulated on the fixture lens and de-icing under wintery conditions. An optional fixture lens 112 can be mounted closely adjacent or proximate to the light-emitting surfaces of the LEDs 106 with a small air gap 114 (e.g., a 0-½" gap) in between. Additional LED lens 116 may be mounted for each individual LED 106 or multiple LEDs 106 to create the desired lighting effect, for example, Fresnel lens for light collimation. In alternative embodiments, those skilled in the art will recognize that any number of devices could be substituted for the lens disclosed, e.g., coverings, light filters, light diffusers, etc.

As shown in FIG. 1A, the heat exchanger 108 may serve in part as the Metal Clad Printed Circuit Board (MCPCB) (which uses a base metal material as the heat spreader portion of the circuit board) of LEDs 106, or may be a separate layer of metal material attached to the MCPCB of LEDs 106, or may be the metal base for mounting LEDs 106 if no printed circuit board is used to wire the LEDs 106. The heat exchanger 108 can be a thick (e.g., ⅛"-¼") aluminum panel or plate having original or matte-black surfaces, for example, although it can be formed from other types, thicknesses, and shapes of materials.

As shown in FIG. 1A, to minimize the heat transfer toward an unwanted direction, a layer of insulating materials 110, such as fiberglass, plastic fiber, foam, aerogel, or an air or vacuum gap, for example, among other suitable insulating materials, is mounted on the back of the heat exchanger 108, but in later examples, it will be revealed that the insulating layer 110 may be mounted on the front of the heat exchanger 108 for the purpose of directing heat. As shown in FIG. 1A, the layer of insulating materials 110 is mounted on the back of the heat exchanger 108. Because the LED heat 104 absorbed by the heat exchanger 108 is insulated from transferring out from the back of the heat exchanger 108, it transfers towards the front in the same direction as that of the light 102 from the LEDs 106 as shown in FIG. 1A. The directed heat can be used for a variety of purposes. For example, the heat could be directed into a body of air, or directed into some other body, e.g., a physical component of the luminaire. The term "body" as used in this application should not be construed in any limiting sense. Unless otherwise specified in the claims, the use of the term should not impart any physical meaning other than that the "body" is something capable of being heated up.

Examples of the kinds of things that can be heated include heating up bodies of air being made available for conditioned interior spaces in building structures and vehicles for a reduction in overall energy uses for space heating, cooling, and lighting. Another example includes using the heat for melting snow accumulated on the fixture lens for the purpose of de-icing outdoor luminaires, signals, video cameras, vehicle headlights and taillights in various outdoor applications under wintery conditions.

Alternatively, a system shown in FIG. 1B includes an arrangement 130 where heat 134 is directed in the opposite direction as that of the light 132. Like with the earlier arrangement, the system 130 includes a plurality of LEDs 136 mounted on a heat exchanger 138, and a fixture lens (or filter, covering) 142 enclosing an air gap 144. Here, however, a layer of insulating materials 140 is mounted on the front of the heat exchanger 138, as shown in FIG. 1B. Those skilled in the art will recognize that heat conducted from LEDs primarily and normally leaves from the side opposite from which light is emitted. Because of this, the insulation 140 has been configured with sized apertures to allow for the LEDs 136 to extend through the insulation 140 such that the LED lenses 146 and a substantial portion of the LED bodies 136 are outwardly exposed in the air gap 144. The base portion of each LED 136 is included in the thickness of the insulation 140. This results in the heat 134 being release primarily backwards as shown in FIG. 1B. Because of this, the LED heat 134 is primarily absorbed by the heat exchanger 138, and is substantially insulated from transferring to any forward portion of the heat exchanger 138. This results in the heat being transferred towards the back in the opposite direction as the light 132 from the LEDs 136 as shown in FIG. 1B. As supplemental to the FIG. 1A version, the heat and light in this arrangement could be used in conditioned interior spaces in buildings for a reduction in overall energy uses for space heating, cooling, and lighting.

In still other embodiments, as shown in FIG. 1C, the layer of insulating materials (like layers 110 and 140 in FIGS. 1A-B) can be omitted completely, and the LED heat 164 can be permitted to radiate off and transfer to both the front and back of the heat exchanger 168, as shown in FIG. 1C. Like with the aforementioned arrangements, a system 160 includes a plurality of LEDs 166 mounted on the heat exchanger 168, and a fixture lens (or filter, covering) 172 enclosing an air gap 174. Here the heat 164 from LEDs 166 is conducted away by the heat exchanger 168. Because there is no insulation, heat is conducted both in the same direction as well as in the opposite direction of the light 162. The integrated light and heat arrangement shown in FIG. 1C might be most useful for integration with the supply air diffusers of the building HVAC system for supplemental reduction in overall energy uses for space heating, cooling, and lighting in the conditioned interior spaces, e.g., by heating up a body of air in the interior space.

Figure 2A:
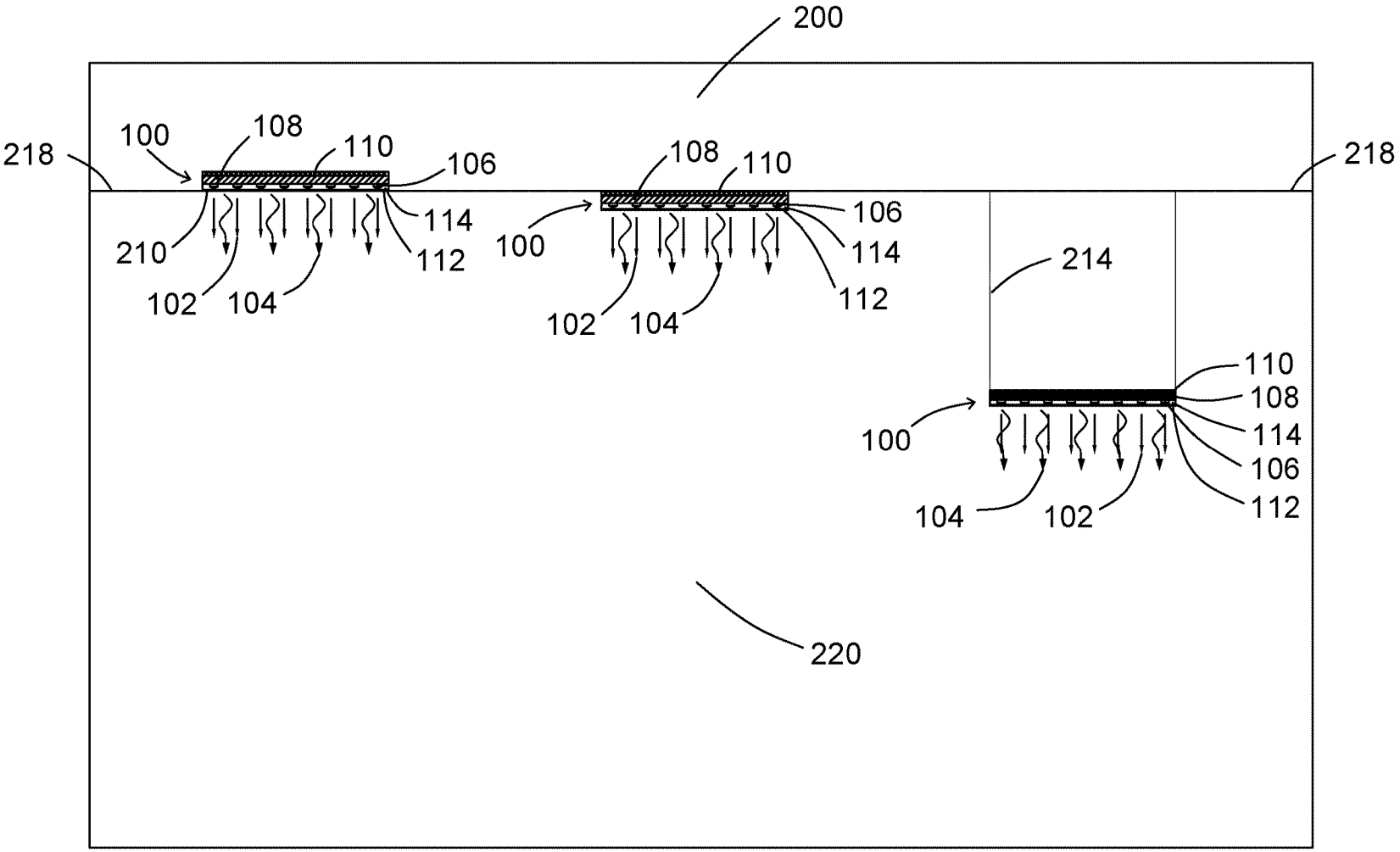
FIG. 2A illustrates an example of ceiling recessed or surface-mounted or pendant integrative low profile luminaire that adopts the first type of fixture system architecture as shown in the embodiment of FIG. 1A.
Figure 2B:
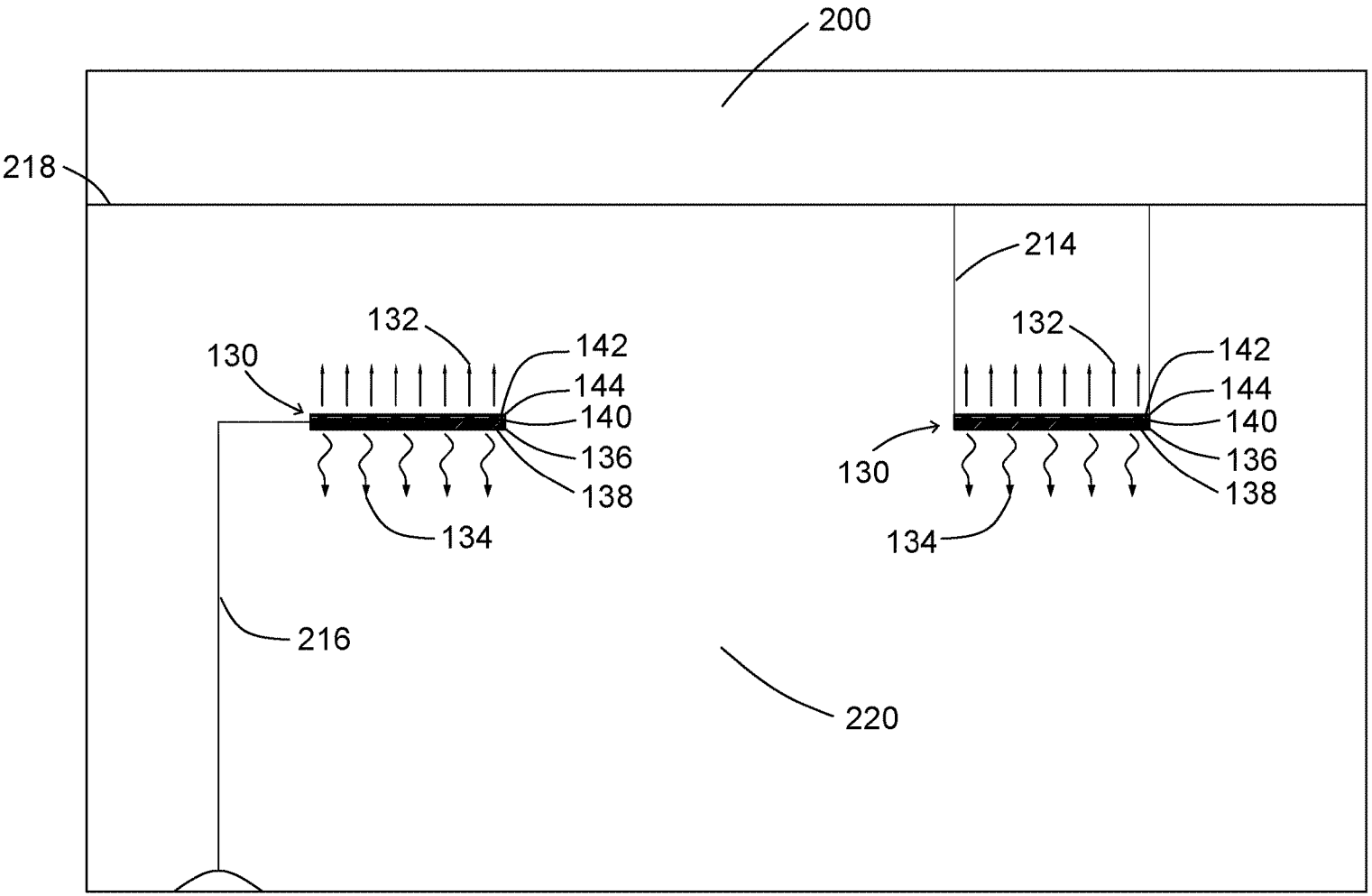
FIG. 2B illustrates an example of pendant or floor standing integrative low profile luminaire that adopts the second type of fixture system architecture as shown in the embodiment of FIG. 1B.
Figure 2C:
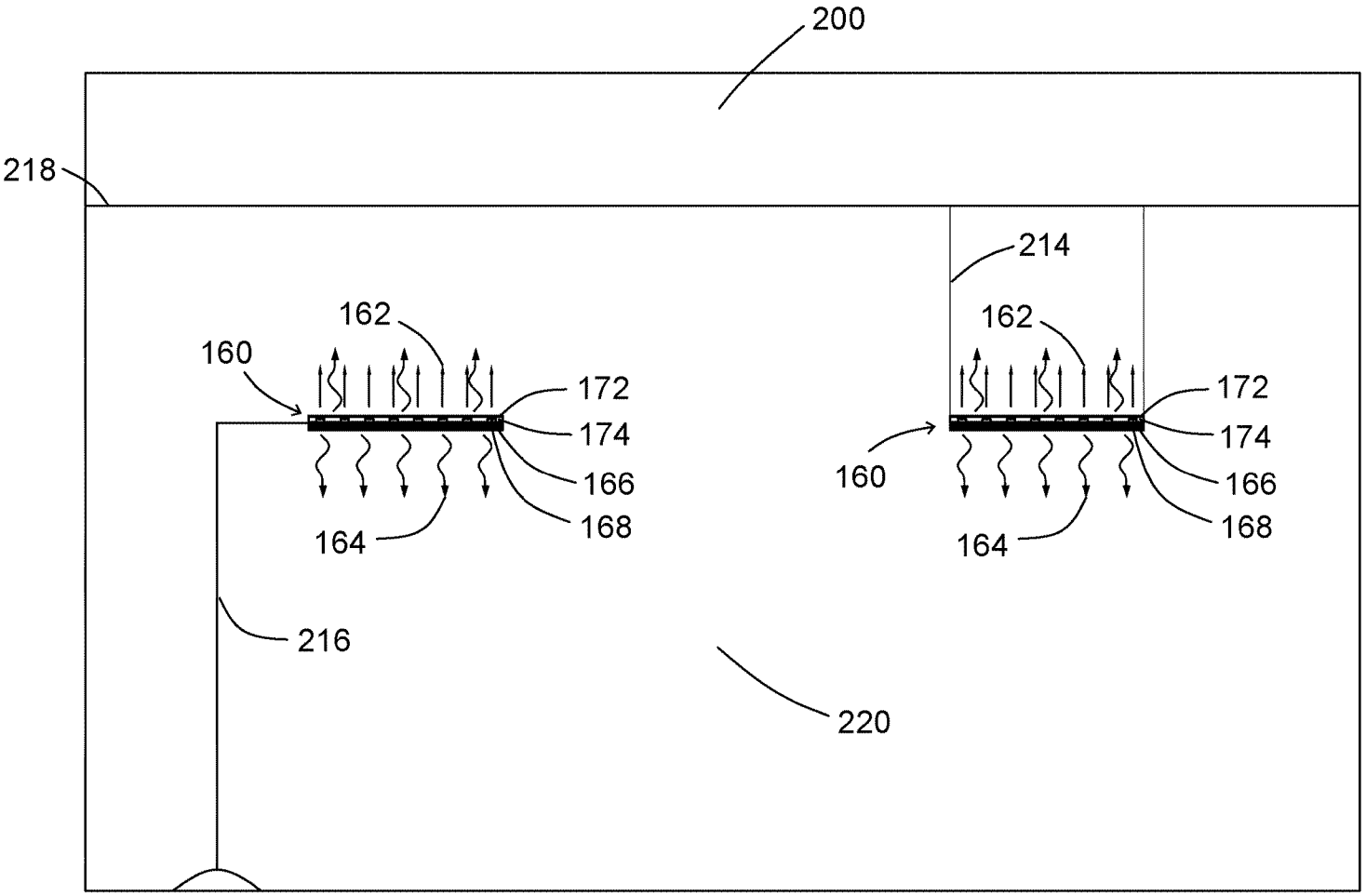
FIG. 2C illustrates an example of pendant or floor standing integrative low profile luminaire that adopts the third type of fixture system architecture as shown in the embodiment of FIG. 1C.

FIGS. 2A-C illustrate examples of different light and heat energy flux mixtures and directionalities in various low profile luminaires according to various embodiments described herein. In the context of the examples shown in FIG. 2A-C, it is noted that other arrangements of layers of insulating materials can be used for other desirable light and heat energy flux mixtures and/or directionalities.

As shown in FIG. 2A, three example integrative low profile LED luminaires that adopts the first type of fixture system architecture 100 are ceiling 218 recessed or surface-mounted or hung from the ceiling 218 using pendant stems 214 in a room that consists of ceiling cavity 200 and conditioned interior space 220. As shown in FIG. 2A, the lens 112 of fixture 100 is aiming downward for downlight. A layer of insulating materials 110 is mounted on the top of the heat exchanger 108 to block heat 104 from radiating towards unwanted directions such as the upper ceiling space 200. The low profile luminaire is designed to provide a mixture of light 102 and heat 104 energy from the LEDs 106 in the same downward direction to the conditioned room space 220.

FIG. 2B illustrates pendant and floor standing integrative low profile LED luminaires that adopts the second type of fixture system architecture 130 as shown in the embodiment of FIG. 1B. In FIG. 2B, the lens 142 of fixture 130 is aiming upward for uplight. A layer of insulating materials 140 is mounted on top of the heat exchanger 138 to help transfer the heat 134 of LEDs 136 in downward direction towards the conditioned room space 220. Meanwhile, the apertures in the insulation layer to allow for the LEDs 136 to extend through the insulation 140 provide light 132 in upward direction towards the ceiling 218 that is reflected back to the interior space 220.

Additionally, in FIG. 2C, pendant and floor standing integrative low profile LED luminaires adopt the third type of fixture system architecture 160. The lens 172 of fixture 160 is also aiming upward for uplight 162, which is reflected by the ceiling 218 back to the room space 220. A layer of insulating materials is omitted in this arrangement 160 to provide a mixture of heat energy 164 in both upward and downward directions in the conditioned interior space 220.

Figure 3:
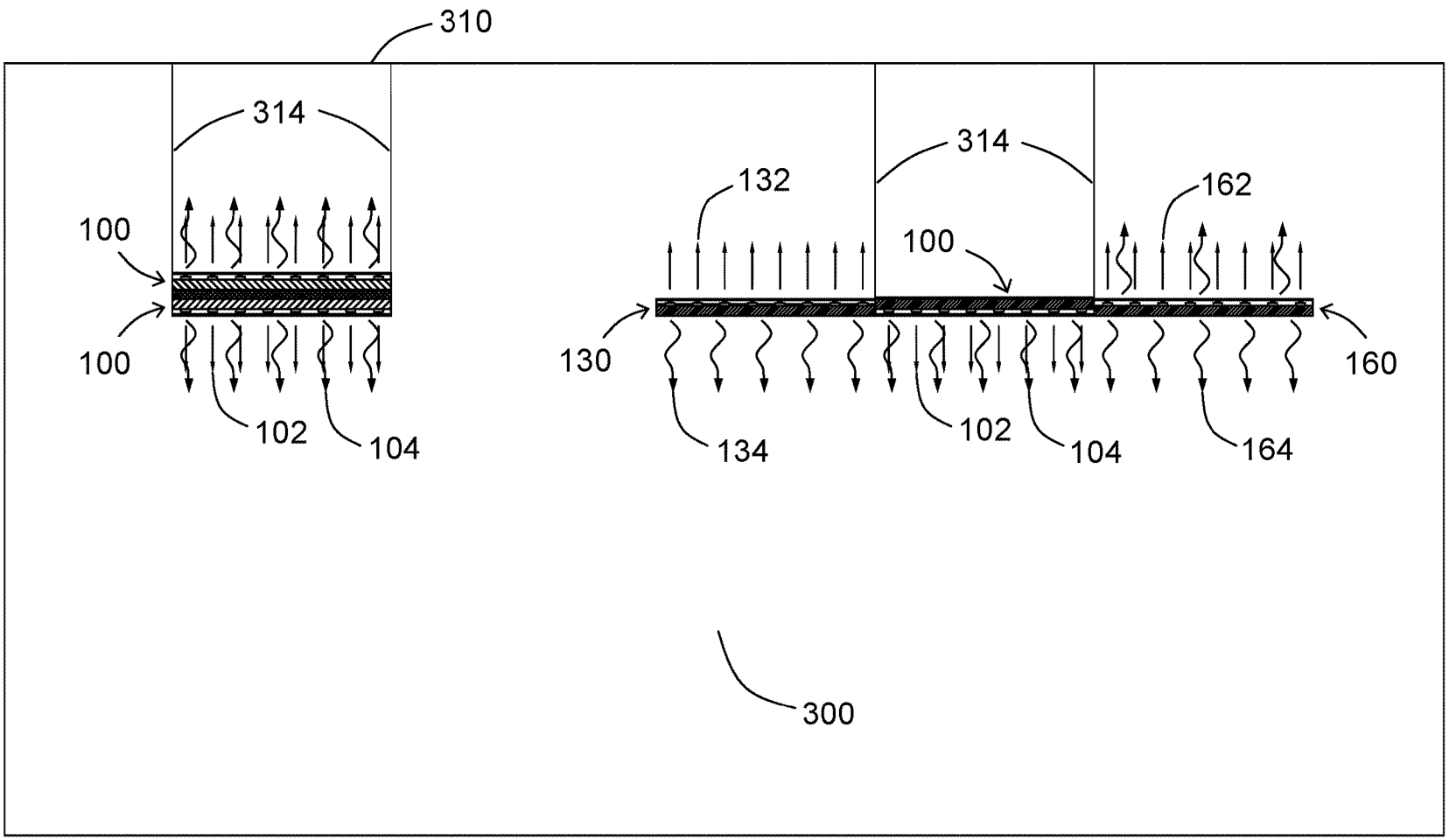
FIG. 3 illustrates examples of plural configurations for an integrative low profile luminaire with multiple fixture modules that adopt the embodiments shown in FIGS. 1A-C.
Figure 4A:
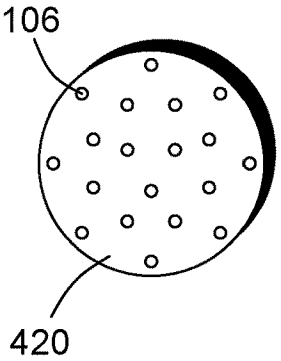
FIG. 4A illustrates the circular form factor of an example integrative low profile luminaire that may adopt various fixture system architectures as shown in the embodiments described herein.
Figure 4B:
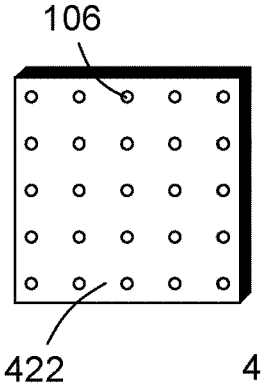
FIG. 4B illustrates the square form factor of an example integrative low profile luminaire that may adopt various fixture system architectures as shown in the embodiments described herein.
Figure 4C:
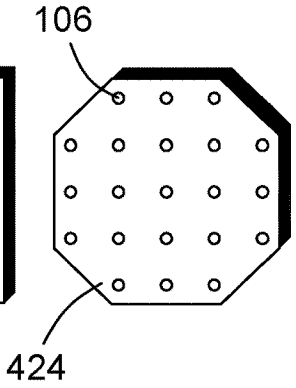
FIG. 4C illustrates the octagon form factor of an example integrative low profile luminaire that may adopt various fixture system architectures as shown in the embodiments described herein.
Figure 4D:
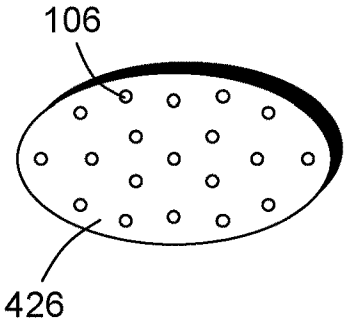
FIG. 4D illustrates the oval form factor of an example integrative low profile luminaire that may adopt various fixture system architectures as shown in the embodiments described herein.
Figure 4E:
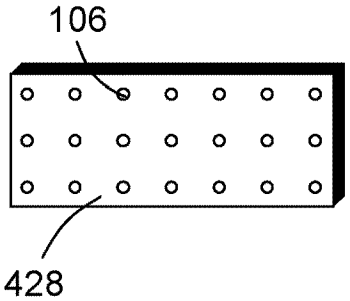
FIG. 4E illustrates the rectangular form factor of an example integrative low profile luminaire that may adopt various fixture system architectures as shown in the embodiments described herein.

Moreover, it is possible to adopt plural configurations for two or more integrative low profile luminaires 100 (FIG. 1A), 130 (FIG. 1B), and 160 (FIG. 1C). As shown in FIG. 3, example pedant fixture hung from the ceiling 310 uses two back-to-back integrative low profile LED luminaire modules 100 as shown in FIG. 1A, one is aiming up, the other one is aiming down. Another example pendant fixture with plural configuration uses three different modules of the integrative low profile luminaires 100 (FIG. 1A), 130 (FIG. 1B), and 160 (FIG. 1C). In the context, other arrangements of plural configurations can be used for other desirable light and heat energy flux mixtures and/or directionalities.

LED fixtures that adopt the system architectures 100, 130, and 160, as shown in FIGS. 1A-C, FIGS. 2A-C and FIG. 3, have a low profile design. The projected thickness of the fixture is probably less than about 1 inch with remote drivers and controllers, or less than about 2-3 inches with integrated drivers and controllers. The low profile design may reduce the required installation space and may also enable more efficient heat transfer from LED lamps to conditioned interior spaces in buildings and vehicles or toward the lens of outdoor LED fixtures. Meanwhile, the light output of each LED can be maximized toward one or more desired directions using an optical LED lens or diffuser having various desired viewing angles. With the aid of fixture lens and individual optical lens sitting above each LED or multiple LEDs, the light arrangement using multiple LEDs in an array in low profile may provide uniform light distribution across the light-emitting surface. Moreover, the new architecture of low profile luminaires may enable a reduction in materials uses for housing and other components, resulting in reduced weight and costs.

According to various embodiments, low profile LED fixtures that adopt the system architectures 100 (FIG. 1A), 130 (FIG. 1B), and 160 (FIG. 1C) for integrative lighting and heating arrangement are described in multiple styles, forms, or form factors, as detailed in various cases below. In these cases, both the light and the heat generated by the same LEDs can be harvested to save energy, resulting in increased overall system energy efficiency.

Example form configurations of the integrative low profile luminaires in embodiments described herein are shown in FIGS. 4A-E. The example configurations include round, square, octagon, oval, and rectangular configurations with various numbers and distribution patterns of LEDs 106 mounted to a heat exchanger in circular shape 420, square shape 422, octagon shape 424, oval shape 426, and rectangular shape 428. The thickness of the fixtures is less than about 1-3 inches. The example configurations are representative and other sizes and shapes of low profile luminaires consistent with the concepts described herein are within the scope of the embodiments. Similarly, any suitable number and arrangement of LEDs can be mounted to heat exchangers in corresponding configurations according to various embodiments.

Turning to other types of LED luminaires that adopt the new system architecture for integrative lighting and heating arrangement, FIGS. 5-7 illustrates various heated supply air diffusers of HVAC systems according to example embodiments described herein. FIGS. 5-7 illustrate how LEDs or other suitable types of lamps can be integrated with (e.g., mounted on) different types of supply air diffusers of the HVAC system for both lighting and heating purposes. For various heated air diffusers, the layer of insulating materials can be omitted, and the LED heat can be transferred both upward and downward, as shown in FIGS. 5-7. The heated air diffusers with LEDs can thus serve the dual function of not only providing lighting to the interior space but also providing a heat exchanger that disperses heat from lamps while directing that heat to supplement the temperature control in the interior space.

Figure 5A:
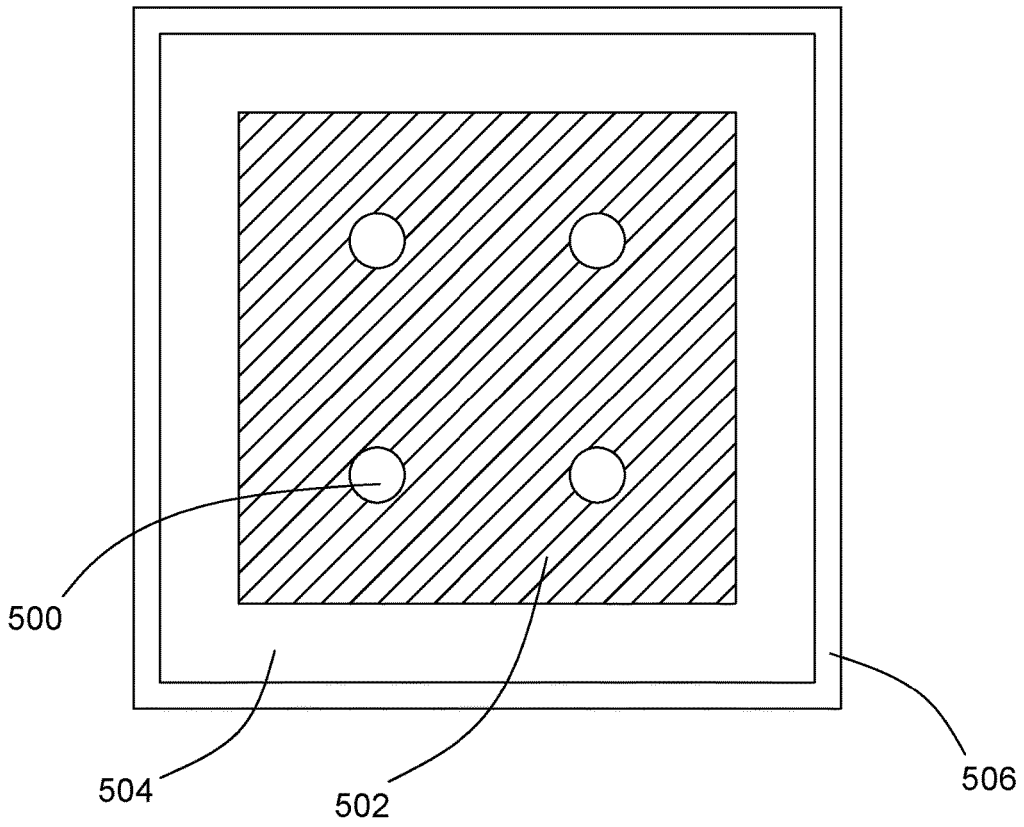
FIGS. 5A-B illustrate an example of heated air diffusers with LEDs or other appropriate small artificial lamps and light sources in an array which are mounted on a square heat exchanger, according to example embodiments described herein.
Figure 5B:
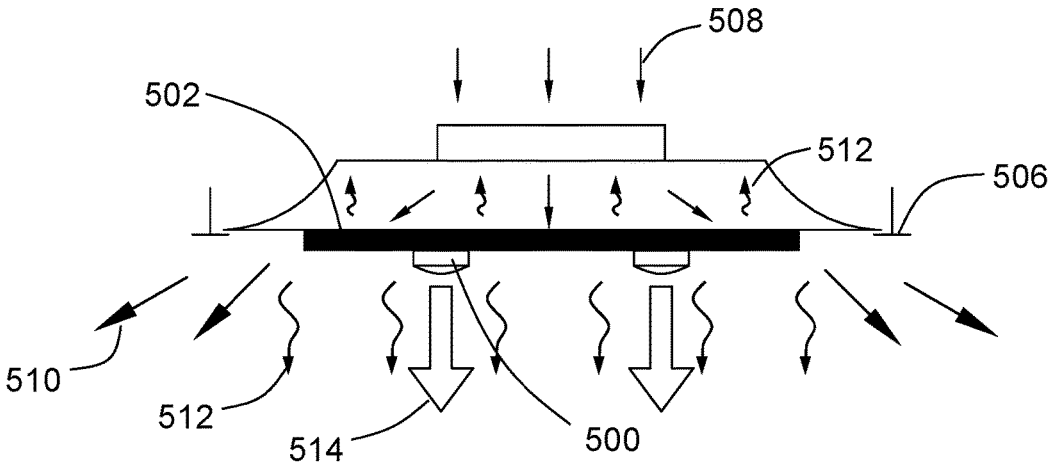
Figure 6A:
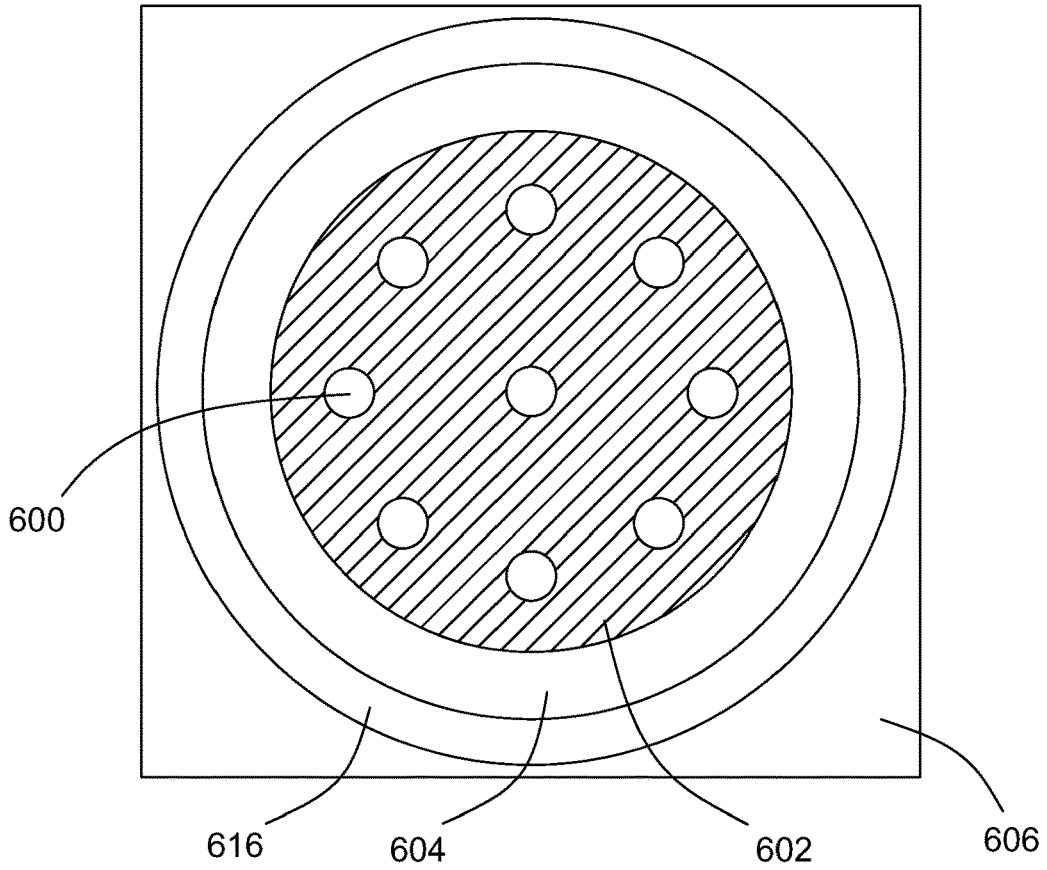
FIGS. 6A-B illustrate an example of heated air diffusers with LEDs or other appropriate small artificial lamps and light sources in an array which are mounted on a circular heat exchanger, according to example embodiments described herein.
Figure 6B:
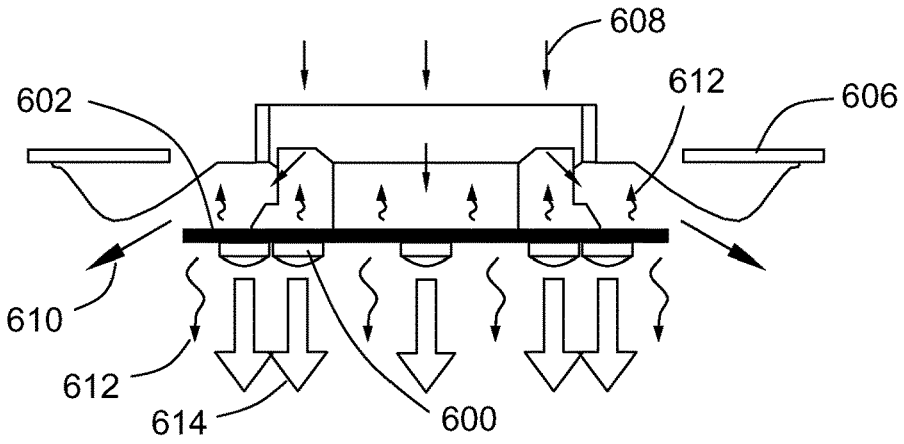
Figure 7A:
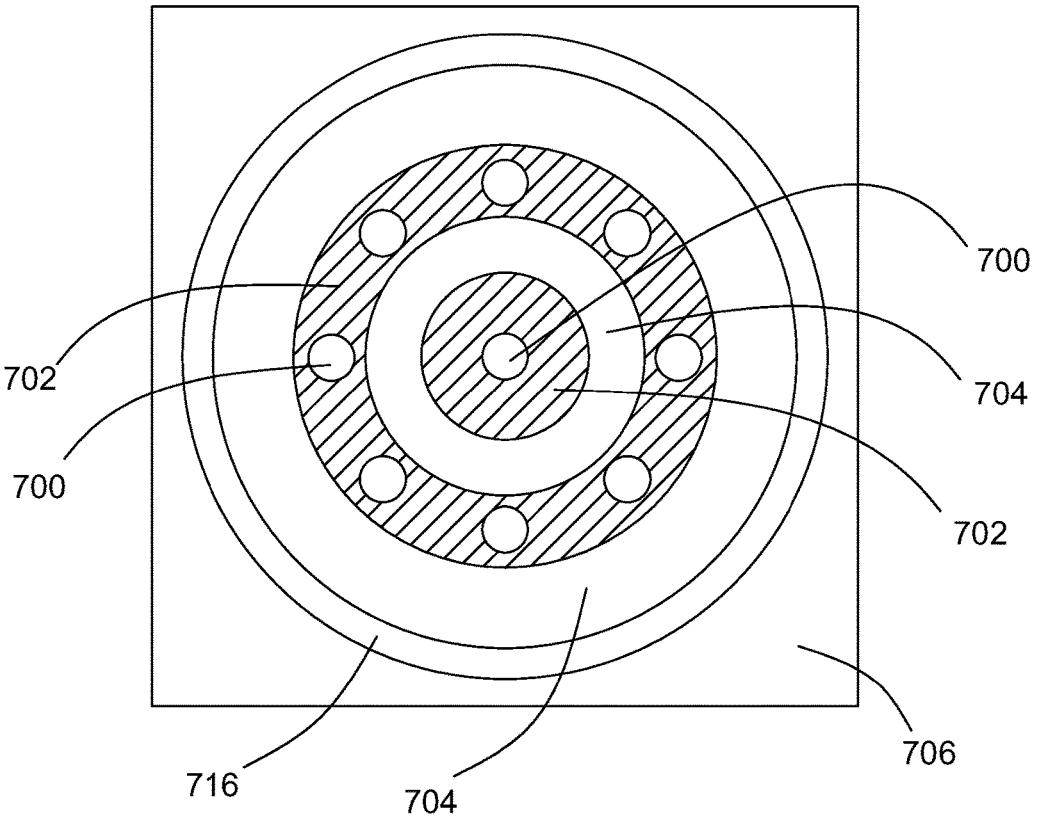
FIGS. 7A-B illustrate an example of heated air diffusers with LEDs or other appropriate artificial lamps and light sources in an array which are mounted on two layers of circular heat exchangers, according to example embodiments described herein.
Figure 7B:
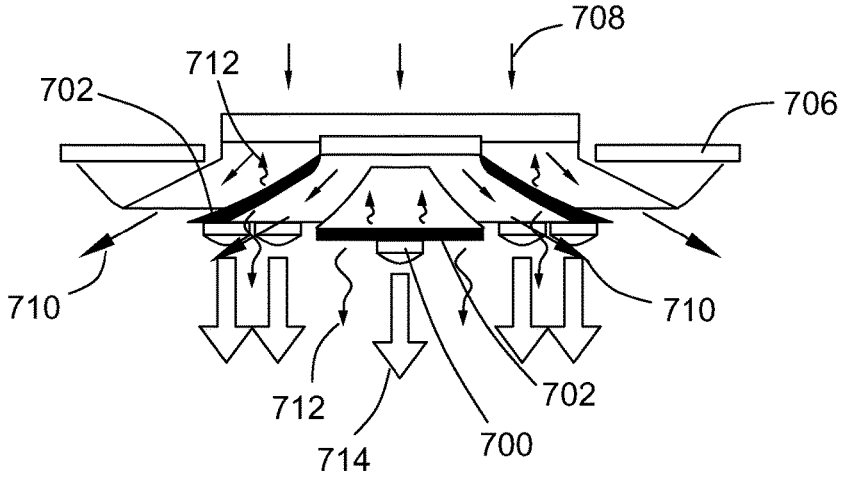

As shown in FIGS. 5A-B, multiple LEDs 500 are mounted on the bottom surfaces of the supply air diffusers in low profile. The air diffusers are designed to act as heat exchangers 502 in square shape to absorb heat 512 from LEDs 500, which is blown away by the supply air 508 provided by the HVAC system into the conditioned body of air in the interior space. Meanwhile, the integrated LEDs 500 provide downlight 514 for the interior space and the air diffuser acts as a ceiling mounted luminaire. Likewise, FIGS. 6A-B illustrate an example heated air diffusers with LEDs 600 and/or other small lamps in an array which are mounted on a single circular heat exchanger 602, according to example embodiments described herein. FIGS. 7A-B illustrate an example heated air diffusers with LEDs 700 and/or other small lamps in an array which are mounted on two layers of circular heat exchangers 702, according to example embodiments described herein.

The heated air diffusers shown in FIGS. 5-7 can be embodied as suitable air diffusers for venting air into interior spaces. The air diffusers can include one or more surfaces, seats, platforms, or other receptacles for mounting lamps, such as LEDs or other suitable types of lamps. As compared to standard air diffusers which may be formed from sheet metal having a relatively lower heat capacity, for example, the heated air diffusers shown in FIGS. 5-7 can be formed from aluminum or another metal or metal alloy having a relatively higher heat capacity. Thus, the air diffusers are designed to act as heat exchangers to absorb heat dissipated from the LEDs or other lamps mounted to the air diffusers. The heat is then passively conducted by the air diffusers and blown away into the interior space by the supply air provided by the HVAC system.

Figure 8:
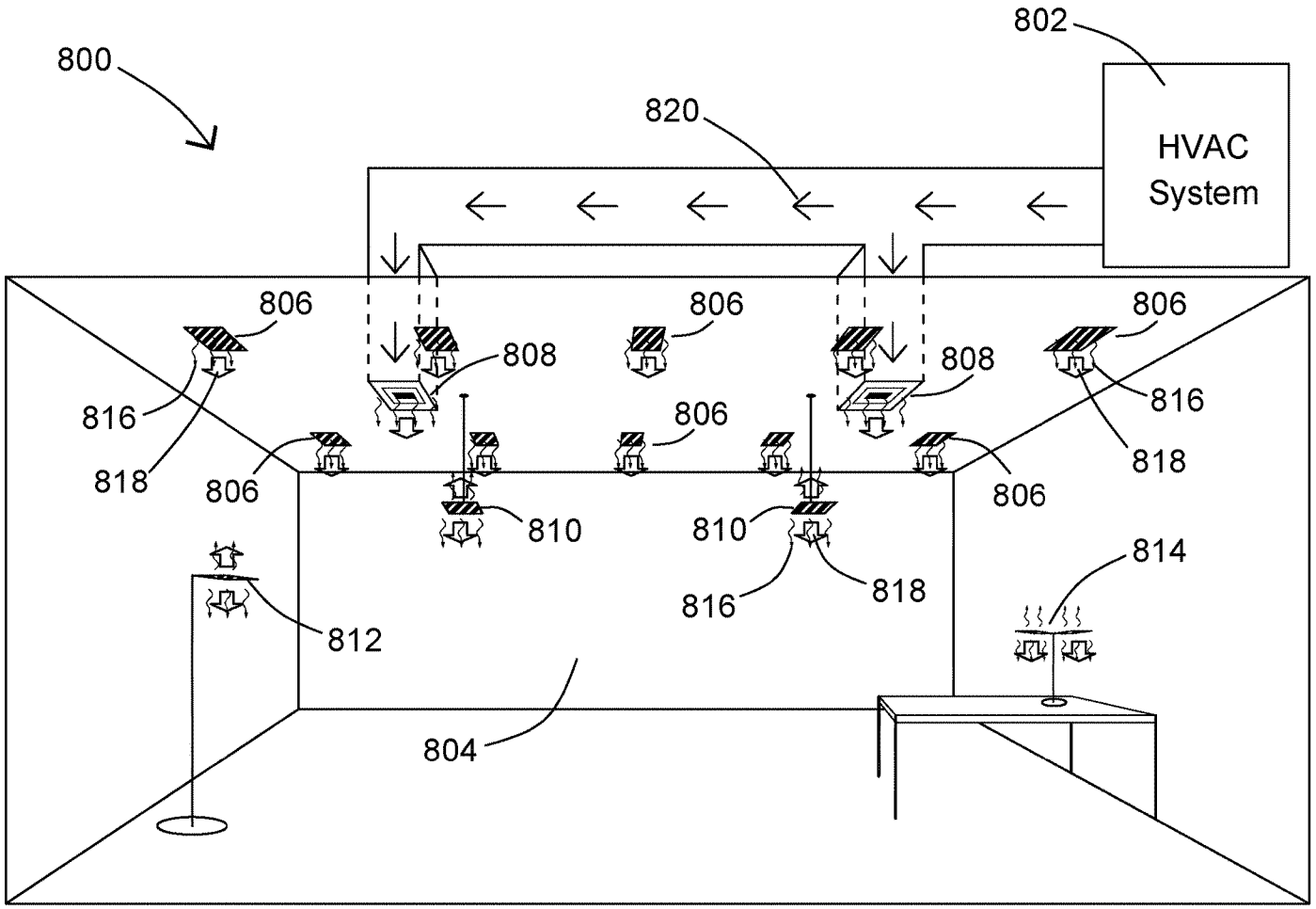
FIG. 8 illustrates an example of integrated illumination and HVAC system that consists of the existing HVAC system and various integrative low profile luminaires that may adopt different fixture system architectures and form factors as shown in the embodiments described herein.

Other example fixture styles may include ceiling/wall recessed, surface (e.g., ceiling, wall, under-cabinet, etc.) mounted, track-mounted, pendant and suspended, floor-standing, pole top, or desk/workstation mounted LED fixtures in low profile. FIG. 8 illustrates an example integrated illumination and ventilation system 800 according to various embodiments described herein. The system 800 is representative and not intended to be limiting of the embodiments. As shown in FIG. 8, the integrative system 800 consists of an HVAC system 802 in fluid (e.g., air) communication with the body of air in the interior space 804 via ductwork and various new types of LED luminaires, which include ceiling mounted fixtures 806, heated air diffusers 808, pedant fixtures 810, floor-standing fixture 812, and table fixture 814, for example. Those luminaires shown in FIG. 8 are configured to generate light 818 from the lamp and direct heat 816 from the lamp in a direction to supplement an efficiency of the HVAC system 802 to reduce energy consumption. The interior space 804 can be embodied as any interior space, such as the interior space of a residential, commercial, or office building, for example.

As one way in which the system 800 can reduce energy consumption, the system 800 can directly rely upon heat 816 generated by the luminaires 806, 808, 810, 812, 814, etc. to heat the interior space 804 when outside temperatures are cold. Thus, the HVAC system 802 can run more sparingly to heat the interior space 804. As another way in which the system 800 can reduce energy consumption, the HVAC system 802 can cool air to a sufficiently low temperature (e.g., 65° F.) to condense and remove moisture from the air in the interior space 804. While that low temperature may be unsuitable for the comfort of individuals in the interior space 804, the luminaires 806, 808, 810, 812, 814, etc. can be used in the system 800 to reheat the air 820 with heat 816 from the lamps in the luminaires 806, 808, 810, 812, 814, etc. without the need (or with less need) for reheat coils in the HVAC system 802.

Figure 9A:
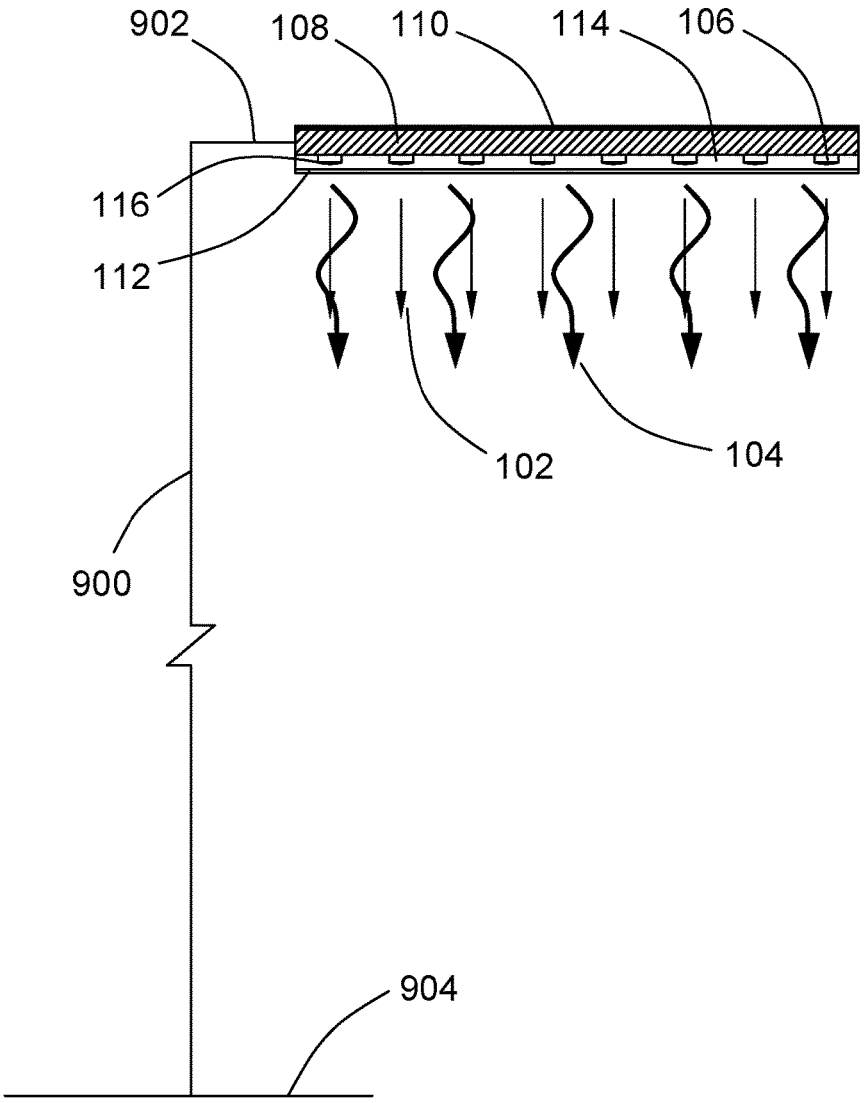
FIG. 9A illustrates an example of integrative low profile LED luminaire for outdoor applications that adopts the first type of fixture system architecture as shown in the embodiment of FIG. 1A.
Figure 9B:
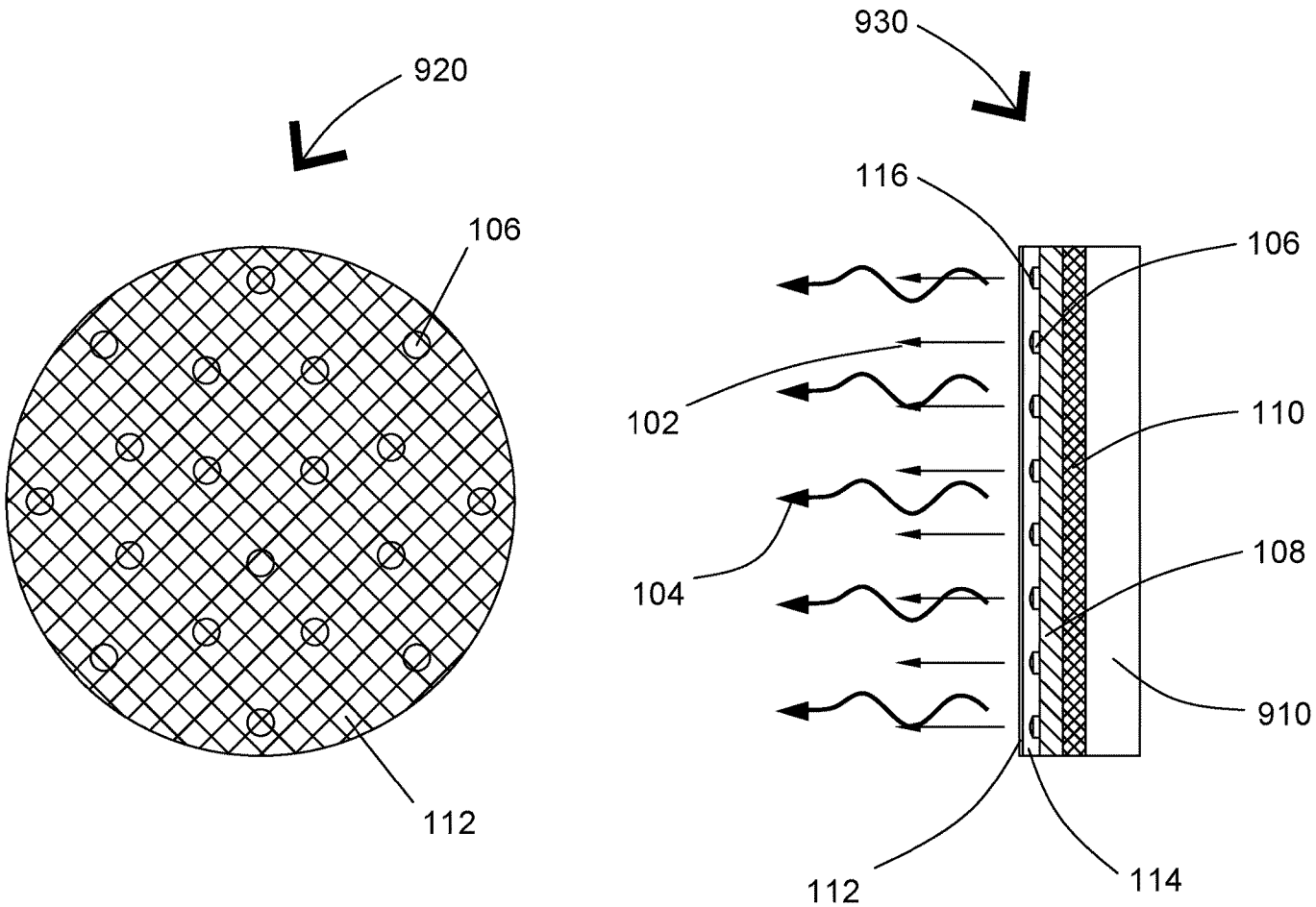
FIG. 9B illustrates another example of integrative low profile LED luminaire for outdoor applications that adopts the first type of fixture system architecture as shown in the embodiment of FIG. 1A.

Outdoor LED fixtures that adopt the new system architectures in low profile for integrative light and heat arrangement can also have various styles and forms or form factors, as examples shown in FIGS. 9A-B. FIG. 9A shows a pole top LED luminaire in low profile design, mounted on a standard pole 900 with an arm 902. LEDs 106 are surfaced mounted on the heat exchanger 108, with a layer of insulation materials 110 on the top. In addition to the fixture lens 112, additional LED lens or diffuser 116 sitting on each LED or multiple LEDs may be used for preferred light distribution patterns. Both the light 102 and heat 104 generated by the LEDs 106 are projected to the desired downward direction to pavement on the ground 904. The LED heat 104 may be used to melt the snow on the fixture lens (or filter, covering) 112 and de-ice under wintery conditions.

Additionally, FIG. 9B shows another example of integrative design of LED fixture in low profile, where colorful light (e.g., red, green, yellow light) or white light LEDs 106 in an array are mounted on the heat exchanger 108 that is approximate to the fixture lens 112 with small air gap 114 of ¼-½ inch or less. A layer of insulation materials 110 is mounted behind the heat exchanger 108 to minimize the heat transferring towards the back in the housing 910. As a result, the LED heat is used to heat the fixture lens 112 in the front to melt snow and de-ice the fixture lens 112 under wintery conditions. Each LED 106 or multiple LEDs 106 may have an optical lens or diffuser 116, for example, Fresnel lens, to help collimate the light to the forward direction. The LED fixtures shown in FIG. 9B may have a reduced thickness of 2-3 inches or less, which can fit in many applications with reduced material uses and thus costs. Likewise, the integrative lighting and heating arrangement and low profile fixture design shown in FIG. 9B may also be used in cars/snowmobiles headlights and taillights of automobiles to melt snow and de-ice in winter.

Although embodiments have been described herein in detail, the descriptions are by way of example. The features of the embodiments described herein are representative and, in alternative embodiments, certain features and elements may be added or omitted. Additionally, modifications to aspects of the embodiments described herein may be made by those skilled in the art without departing from the spirit and scope of the present invention defined in the following claims, the scope of which are to be accorded the broadest interpretation so as to encompass modifications and equivalent structures.

The invention claimed is:

1. A system comprising:

at least one solid-state luminaire, the luminaire integrating lighting and heating functions, the luminaire having a light source, the light source having a light-emitting side and a back side, the back side emitting heat when said luminaire is emitting light, the back side of the light source being directly mounted onto, and directing heat into a heat-conductive substrate configured to operate as a passive heat exchanger; and the heat-conductive substrate is configured to introduce the heat into a body, the body existing in a proximate ambient environment, the body comprising one of air or a luminaire component, and thermally condition the body using the heat; wherein an insulating layer is mounted on a back surface of the heat-conductive substrate such that the heat-conductive substrate directs the heat in substantially a same direction as the light generated by the light source.

2. The system of claim 1, wherein the insulating layer covers portions of the heat-conductive substrate, the insulating layer preventing the heat from escaping into areas other than the body intended for thermal conditioning.

3. The system of claim 1, wherein an insulating layer is mounted onto a front surface of the heat-conductive substrate such that the heat-conductive substrate also directs the heat in a substantially opposite direction relative to the light emitted from the light source.

4. The system of claim 1, wherein the body is a source of traveling air in a heating, ventilating, and cooling (HVAC) system, and an insulator covers surfaces of the heat-conductive substrate to direct the heat into the source of traveling air such that the traveling air is reheated before being delivered into an interior space of a building conditioned by the HVAC system.

5. The system of claim 4 wherein the luminaire comprises an air-handling component included in the HVAC system, the light source being mounted onto the air-handling component, the air-handling component opening into the proximate ambient environment, which is a climate-controlled space.

6. The system of claim 5, wherein the air-handling component is an air diffuser.

7. The system of claim 1, wherein the light source includes at least one light emitting diode (LED).

8. The system of claim 1, wherein the luminaire comprises a plurality of light sources each comprising one or more LED lamps.

9. The system of claim 1, comprising:

the at least one luminaire comprising a first luminaire and a second luminaire, the first and second luminaires each having a first heat-conductive substrate and a second heat-conductive substrate respectively;

each of the first and second substrates having different form factors while maintaining passive heat exchange and further enabling a variety of low profile lamp configurations.

10. An illumination system, comprising:

at least one light emitting diode (LED) having an illumination direction, and a back portion, the back portion of the LED being directly secured to a front side of a heat-transmitting substrate, the substrate configured to operate as a passive heat exchanger such that a heat output is conducted into the substrate while the LED is illuminated; and insulation applied behind the substrate deflects the heat output such that the heat output will be in the same direction as the illumination direction of the LED and such that the heat output assists in creating a desirable temperature characteristic in an object in front of the heat-transmitting conduit.

11. The system of claim 10 wherein the object is one of a: (i) lens, or (ii) light diffuser and the desirable temperature characteristic relates to preventing the buildup of one of snow and ice on the object.

12. A system for illuminating and controlling the conditions of a body of air in a space, the system including:

a plurality of luminaires; each of said luminaires having at least one light emitting diode (LED), each LED having a light-emitting side and a back side, each luminaire configured such that the back side of each LED introduces heat directly into a heat-conductive substrate configured to operate as a passive heat exchanger, the passive heat exchanger positioned to directly thermally condition the body of air when said LED is emitting light and condition the air using the heat to improve a condition of the air in the space contiguous with the illuminating system; and wherein insulation applied behind the substrate deflects the heat such that the heat is output in the light emitting direction.

13. The system of claim 12, wherein the LED of one of the luminaires is integrated with an air diffuser of a heating, ventilating, and cooling (HVAC) system serving the space.

14. The system of claim 13, wherein the HVAC system is configured to cool air to condense and remove moisture for humidity control in an interior space at least one of the plurality of luminaires are configured to reheat the air with heat from the LEDs.

15. The system of claim 12 wherein the plurality of luminaires include at least one of an air diffuser, a ceiling mounted fixture, a pendant fixture, a floor-standing fixture, or a table fixture.

16. The system of claim 1, wherein the substrate is configured to operate as a passive heat exchanger using a metal composition and a particular thickness.

17. The system of claim 1 wherein the passive heat exchanger extends substantially laterally relative to a light-emission direction.

18. The system of claim 17 wherein the passive heat exchanger is substantially planar configuration.

19. The system of claim 18 wherein the substantially planar configuration is incorporated into a low-profile design for the luminaire.

* * * * *